US005890493A

United States Patent [19]

Horng

[11] Patent Number: 5,890,493

[45] Date of Patent: Apr. 6, 1999

[54] TOOTH CLEANING ASSEMBLY

[76] Inventor: Bae Yan Horng, P.O. Box 82-144, Taipei, Taiwan

[21] Appl. No.: 143,434

[22] Filed: Aug. 28, 1998

[51] Int. Cl.[6] ..... A45D 44/18; A45D 40/24

[52] U.S. Cl. ..... 132/310; 132/314; 132/308; 132/309

[58] Field of Search ..... 132/314, 308, 132/309, 310, 316, 301, 303, 304, 291

[56] References Cited

U.S. PATENT DOCUMENTS

| | | | |
|---|---|---|---|
| 1,680,196 | 8/1928 | Austin | 132/314 |
| 2,136,843 | 11/1938 | Dinkel | 132/314 |
| 5,215,193 | 6/1993 | Dennis | 132/314 |
| 5,400,839 | 3/1995 | Cravett | 132/314 |
| 5,617,884 | 4/1997 | Allison | 132/310 |
| 5,638,840 | 6/1997 | Lee et al. | 132/310 |

*Primary Examiner*—John J. Wilson
*Assistant Examiner*—Trang Doan
*Attorney, Agent, or Firm*—A & J

[57] ABSTRACT

A tooth cleaning assembly includes a rack, at least a detachable toothpaste squeezing assembly mounted on the rack and including a base, a toothpaste cylinder having a lower end fitted in the base, an annular member arranged an upper end of the toothpaste cylinder, a cover fitted on a top of the toothpaste cylinder and mounted on the annular member, a tubular neck telescopically fitted in the toothpaste cylinder, a cap pivotally connected with an upper end of the tubular neck, and a movable knob extending through the rack to be detachably engaged with a bottom of the base, at least a toothbrush detachably mounted on the annular member, at least a spring mug fitted within the rack, and at least a folding mirror fitted within the rack, whereby all commonly used washing articles are combined into one unit thereby making them convenient to use and arranging them in a tidy manner.

6 Claims, 13 Drawing Sheets

TOOTH CLEANING ASSEMBLY

BACKGROUND OF THE INVENTION

1. Field of the Invention

This invention is related to an improved tooth cleaning assembly.

2. Description of the Prior Art

Generally, the toothbrush, toothpaste and tooth mug are separately placed on a vanity cabinet in the bathroom. When desired to brush teeth, it is necessary to hold the toothpaste with one hand, open the cap of the toothpaste with another hand, hold the toothbrush with the another hand, squeeze the toothpaste on to the toothbrush, and then put the toothpaste back to the vanity cabinet, thereby causing much inconvenience in use. Hence, various kinds of toothpaste squeezers have been developed to attempt to eliminate this drawback, but it is still necessary to align the toothpaste with the toothbrush and squeeze the toothpaste onto the toothbrush in use thus making them unsatisfactory and unfit for practical use.

Therefore, it is an object of the present invention to provide a tooth cleaning assembly which can obviate and mitigate the above-mentioned drawbacks.

SUMMARY OF THE INVENTION

This invention is related to a tooth cleaning assembly.

It is the primary object of the present invention to provide a tooth cleaning assembly which combines all commonly used washing articles into one unit thereby making them convenient to use and arranging them in a tidy manner.

It is another object of the present invention to provide a tooth cleaning assembly which enables one to choose the desired toothbrush and toothpaste easily by the rotation of the annular member and the toothpaste squeezing assembly.

It is still another object of the present invention to provide a tooth cleaning assembly which will automatically apply toothpaste to a desired toothbrush.

It is still another object of the present invention to provide a tooth cleaning assembly which is compact in size.

It is a further object of the present invention to provide a tooth cleaning assembly of which the toothbrush and toothpaste can be foldably connected together thus making it easy to carry and fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
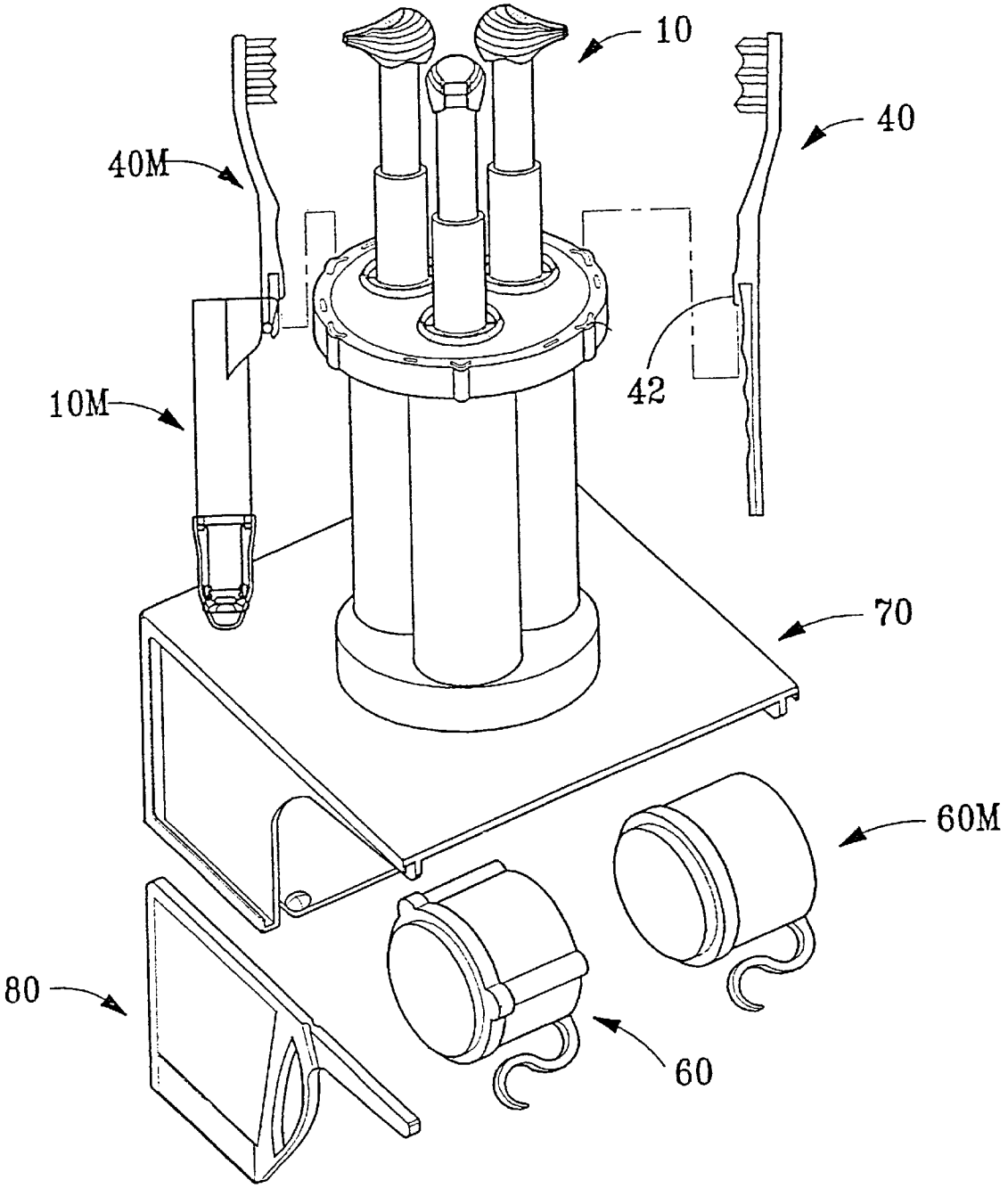
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
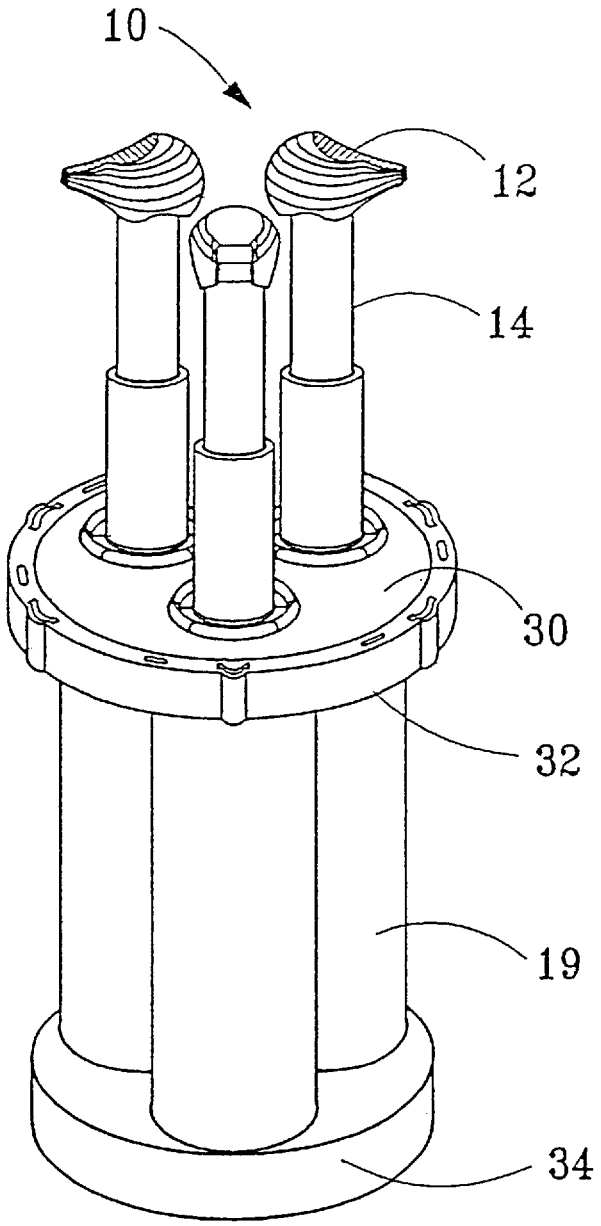
FIG. 2 is a perspective view of the present invention.
Figure 3:
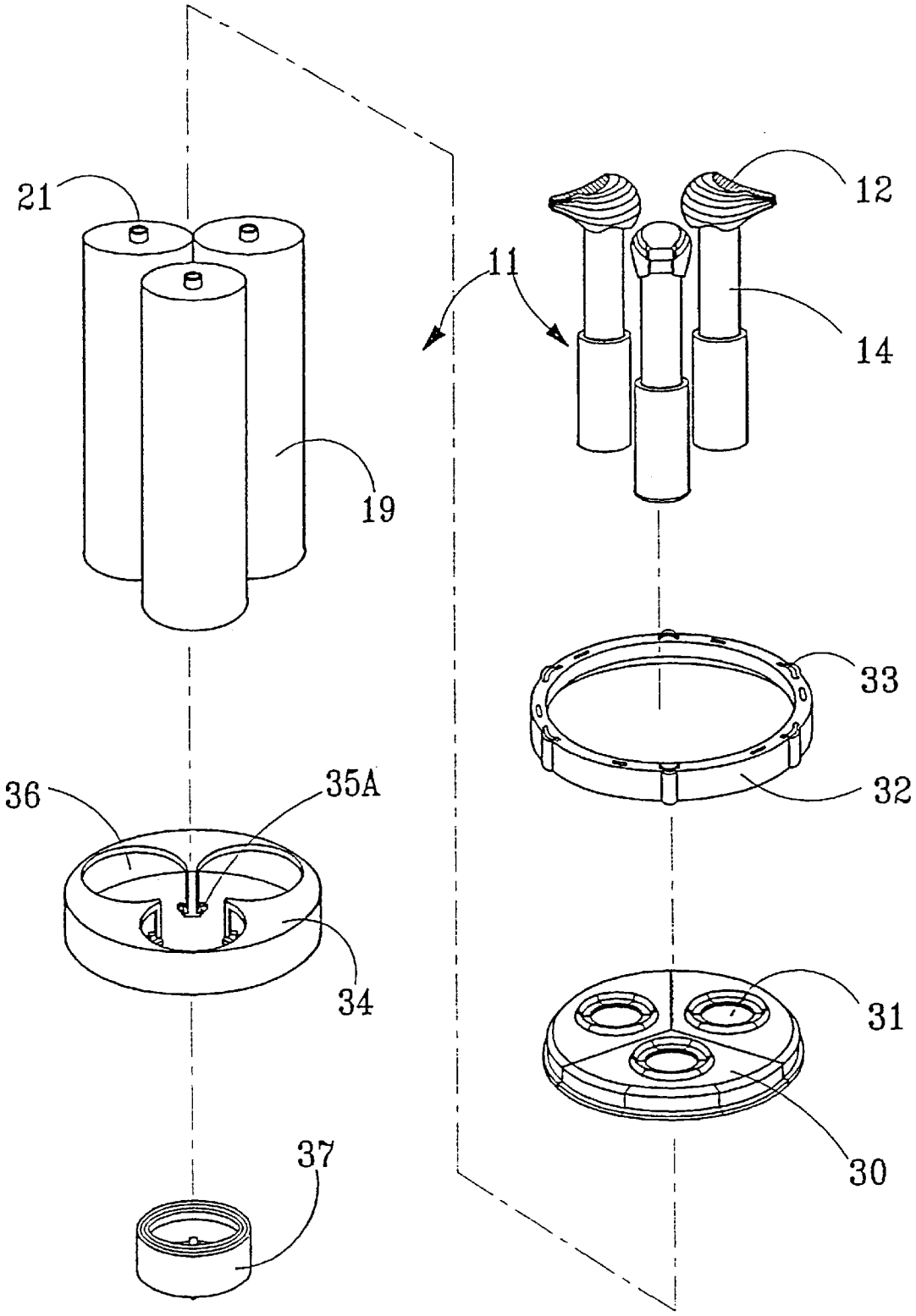
FIG. 3 is an exploded view of the toothpaste squeezing device.

With reference to the drawings and in particular to FIG. 1 thereof, the tooth cleaning assembly according to the present invention generally comprises toothpaste squeezing assemblies 10 and 10M, tooth brushes 40 and 40M, spring mugs 60 and 60M, a folding mirror 80 and a rack 70. Referring to FIGS. 2 and 3, the toothpaste squeezing assembly 10 includes caps 12, tubular necks 14, toothpaste cylinders 19, an annular member 32 with slots 33, a cover 30, a base 34 and a movable cap 37. The caps 12, tubular necks 14 and toothpaste cylinders 19 are joined together form a toothpaste squeezer 11. The movable cap 37 is engaged with the base 34. The. toothpaste cylinder 19 is fitted in the hole 36 of the base 34 and kept in place by the hooks 35. The upper end of the toothpaste cylinder 19 is engaged with the cover 30 which is in turn kept in place by the annular member 32. The outlet 21 at the top of the toothpaste cylinder 19 is connected with the lower end of the tubular neck 14 to form a toothpaste squeezer 10.

Figure 4:
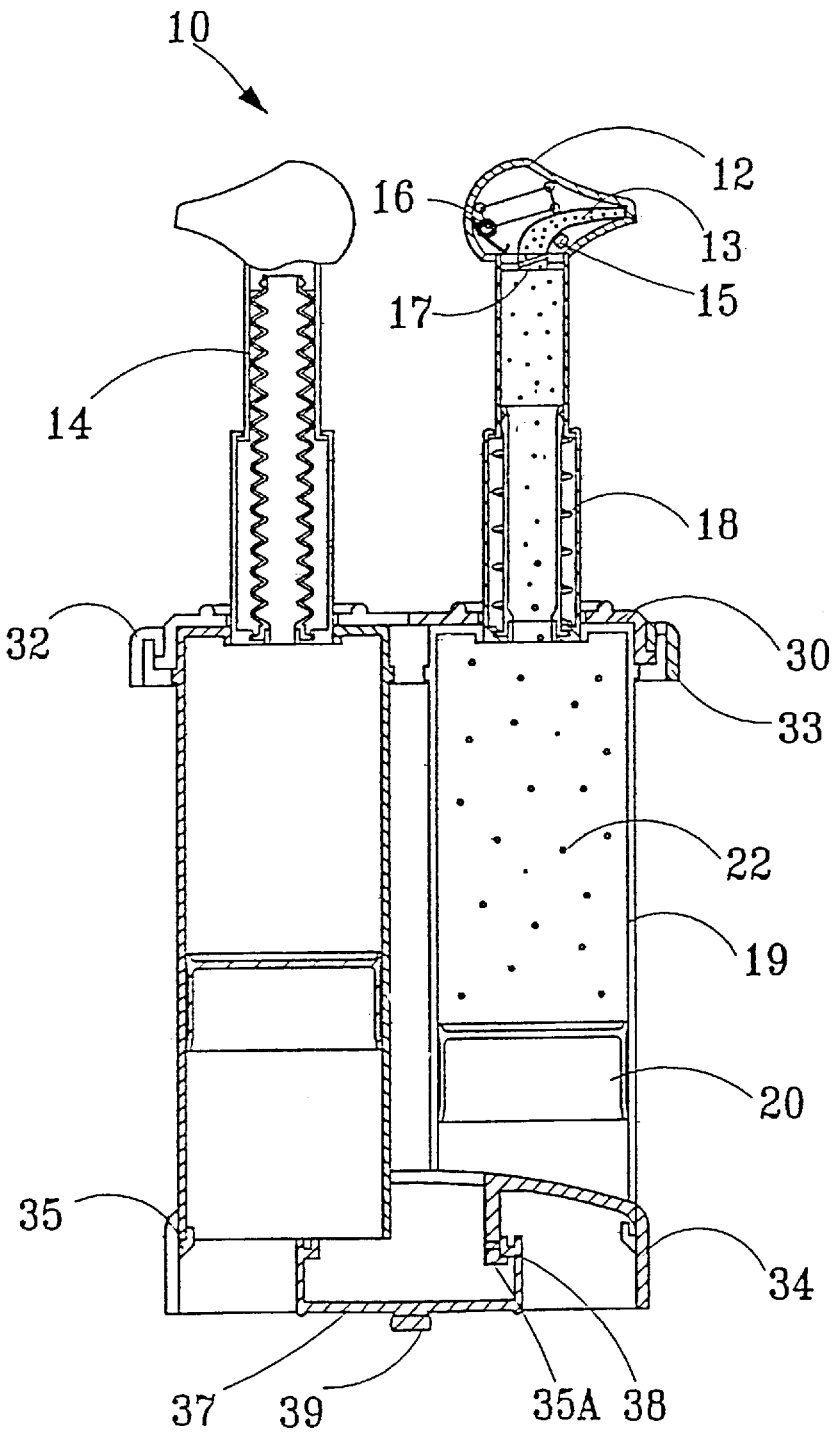
FIG. 4 is a sectional view of the toothpaste squeezing device.

As shown in FIGS. 3 and 4, the toothpaste squeezer 10 includes cap 12, spring 16, check valve 17, tubular neck 14, spring 18 and toothpaste cylinder 19. The lower end of the tubular neck 14 extends through hole 31 of the cover 30 to engage with an outlet 21 of the toothpaste cylinder 19. The annular member 32 is mounted on the outer edge of the cover 30. A piston 20 is fitted inside the lower end of the toothpaste cylinder 19 thereby forming a chamber for receiving toothpaste 22. The toothpaste squeezer 10 is fitted in the hole 36 of the base 34, with the hooks 35 supporting the toothpaste cylinder 19. When in use, it is only necessary to press the cap 12 to rotate about an axle 15, open the cap 12 to expose the outlet 13, keep on pressing the cap 12 to apply toothpaste 22 to the head of the tooth brush, and then remove the tooth brush 40 and/or 40M for use. Meanwhile the springs 18 and 16 force the tubular neck 14 and the cap 12 to return to their original positions respectively. In addition, the cap 12 may be provided with a resiliently closed air whistle (not shown) or a music integrated circuit so that when the cap 12 is opened, music will be sent out to make it become interesting. Furthermore, the tubular neck 14, the cover 13, the toothpaste cylinder 19 and the base 34 may be partially or all formed integrally, but the hook 35 must be made as a single component so as to enable it to replace the toothpaste cylinder 19 from the bottom.

Figure 5A:
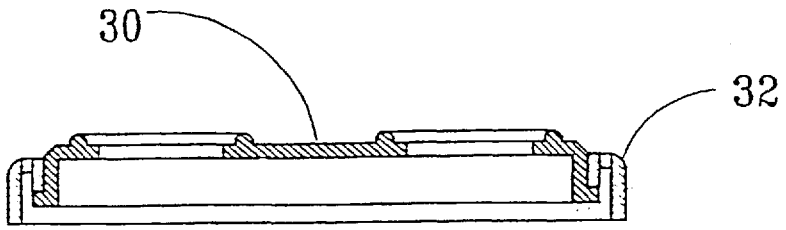
FIG. 5A is a sectional view illustrating the engagement between the annula member and the cover.
Figure 5B:
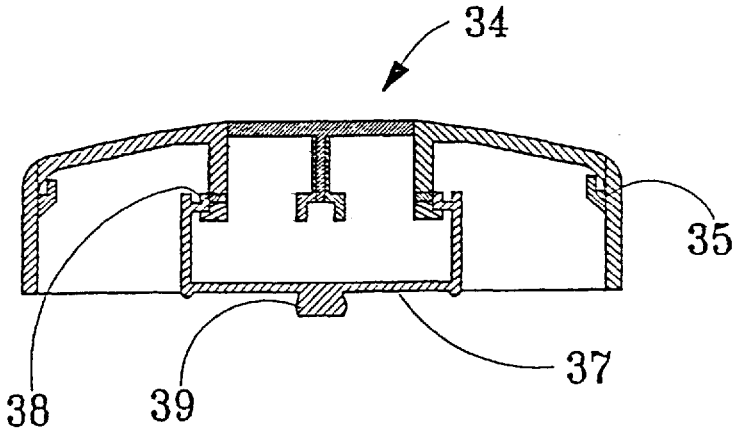
FIG. 5B is a sectional view illustrating the engagement between the base and the detachable knob.
Figure 6A:
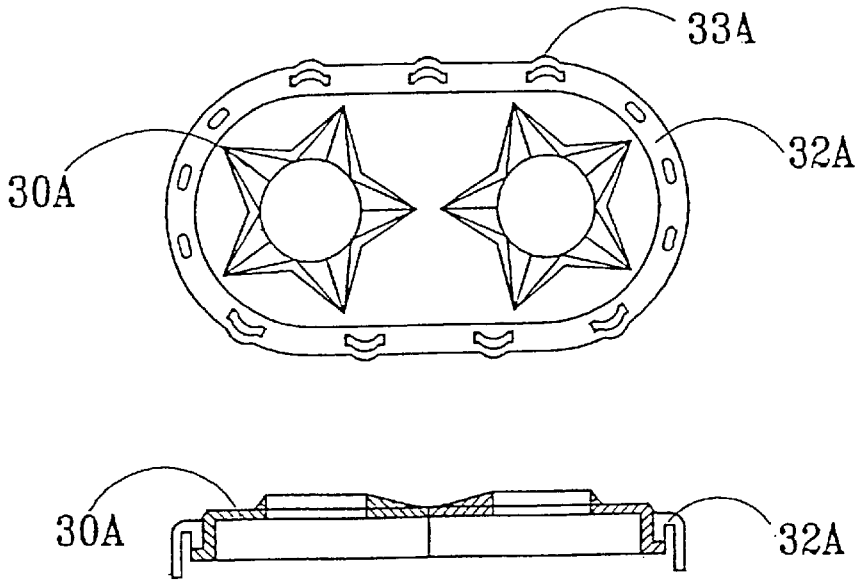
FIG. 6A shows a second preferred embodiment of the annular member and the cover.
Figure 6B:
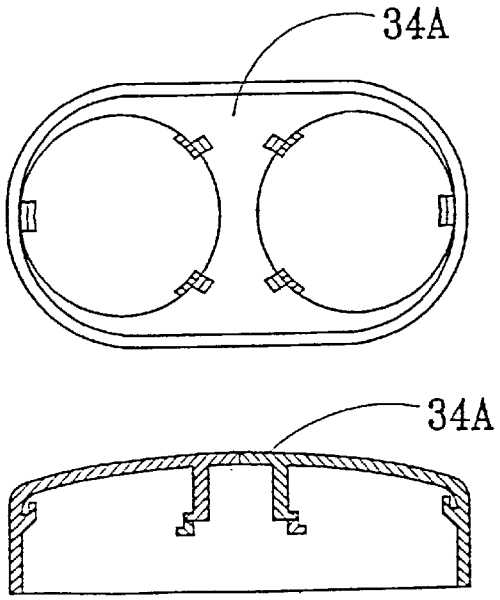
FIG. 6B shows a second preferred embodiment of the base of the toothpaste squeezing assembly.
Figure 7:
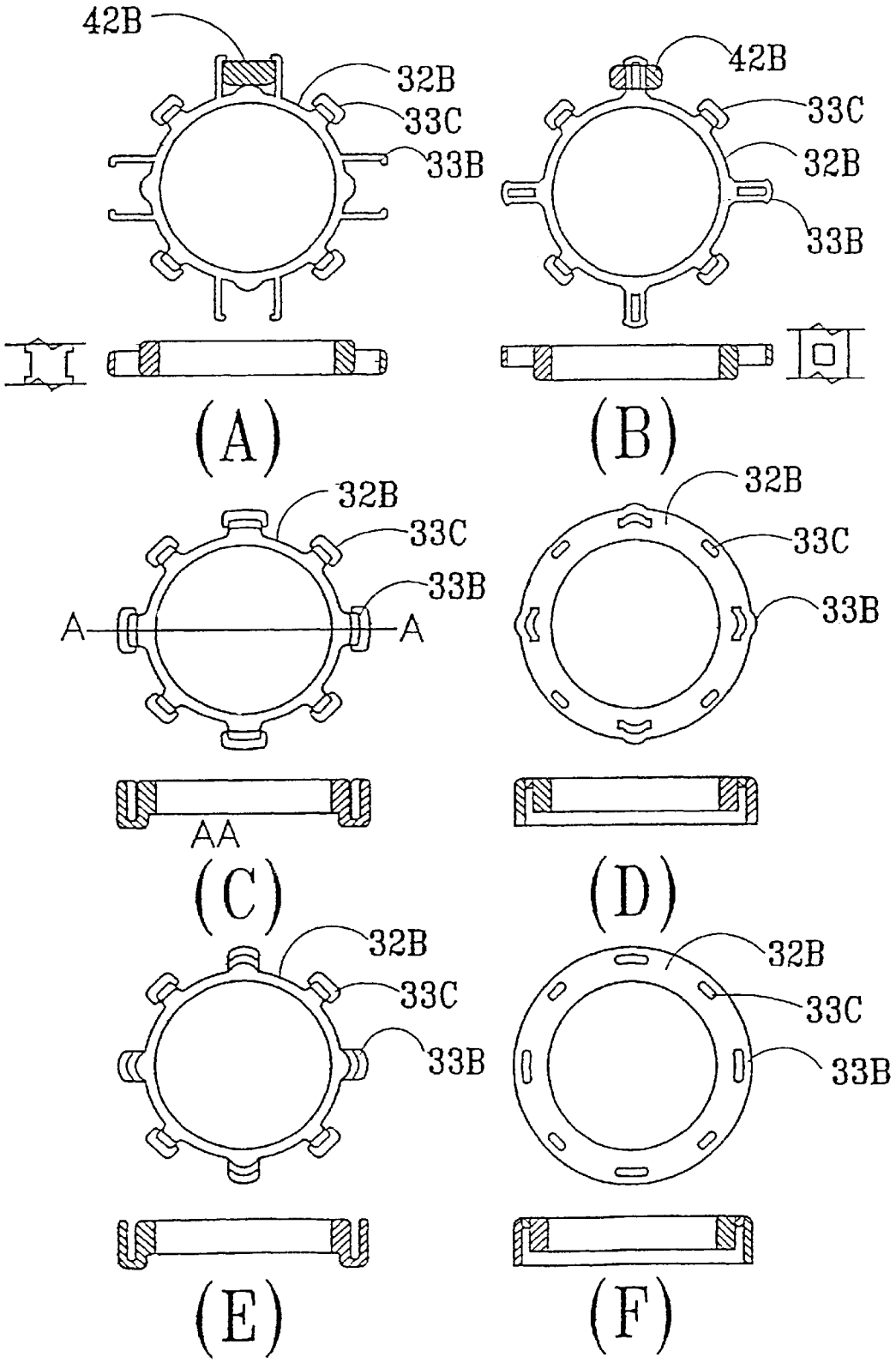
FIGS. 7A, 7B, 7C, 7D, 7E and 7F illustrate another six preferred embodiments of the annular member of the toothpaste squeezing assembly.

FIG. 5A is a sectional view showing the engagement between the cover 30 and the annular member 32. FIG. 5B is a sectional view illustrating the engagement between the base 34 and the detachable knob 37. FIGS. 6A and 6B illustrate a second preferred embodiment of the present invention, wherein the annular member 32A, the cover 30A and the base 34A are formed with two holes. In addition, the toothpaste squeezer may be directly engaged with the detachable knob 37 at the bottom and with a single-hole annular member 32B at the top. Further, as shown in FIGS. 7A, 7B, 7C, 7D, 7E and 7F, the ears 33, 33A and 33B of the annular members 32, 32A and 32B may be of different types so as to be adapted for use with different types of toothbrushes 40, 40M and hook 42, thereby increasing the practicality and beauty. In other words, the present invention may be provided with one or more toothpaste squeezers 11 to form a desired toothpaste squeezing assembly 10. The small lug 33C is a hooked used for hanging long-handled dental mirror (not shown).

Figure 8A:
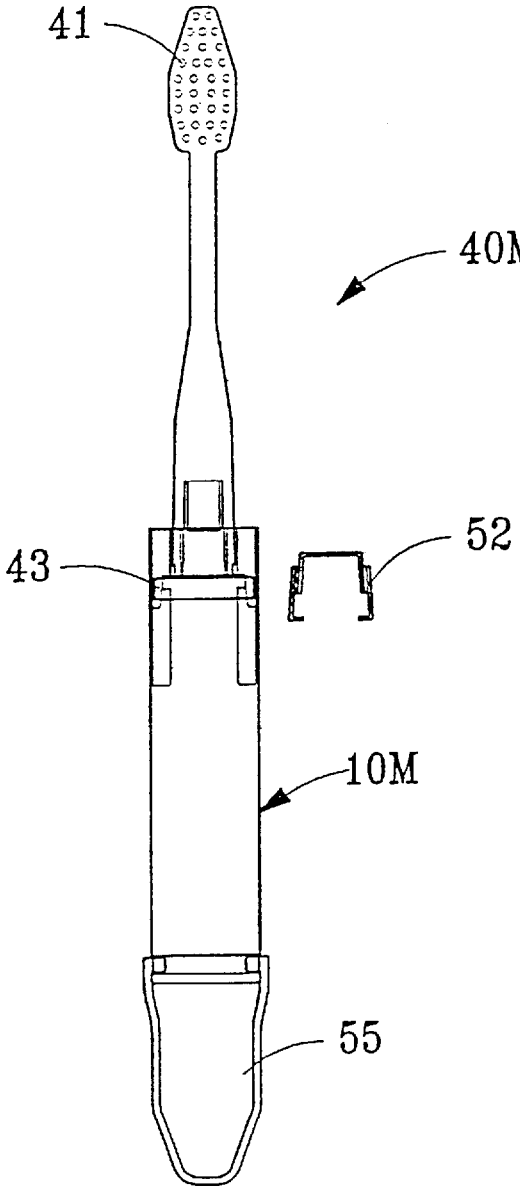
FIGS. 8A and 8B illustrate a front and side views of a second preferred embodiment of the toothbrush and toothpaste squeezing assembly in unfolded condition.
Figure 8B:
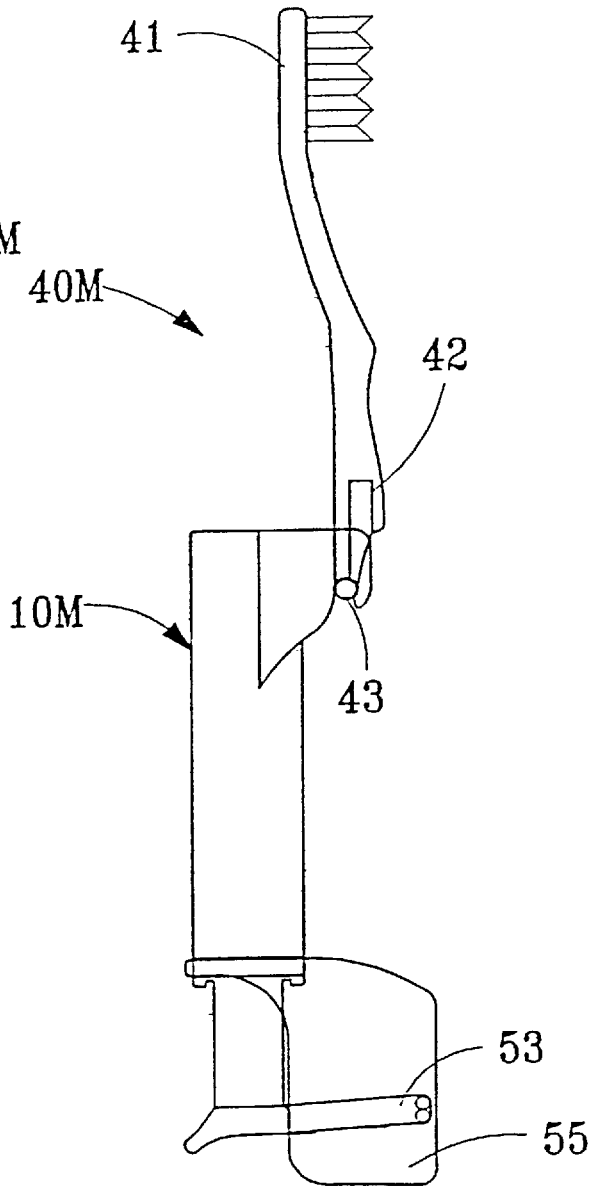
Figure 9A:
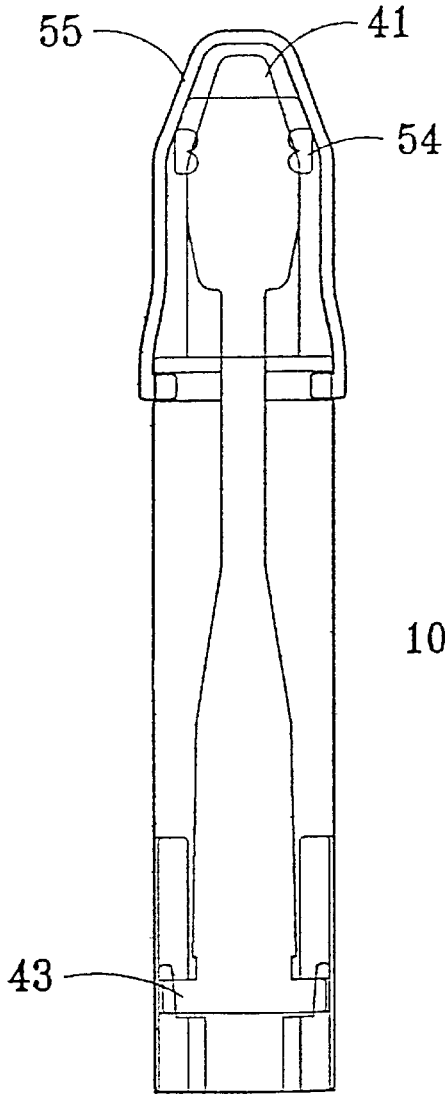
FIGS. 9A and 9B illustrate a front and side views of the second preferred embodiment of the toothbrush and toothpaste squeezing assembly in folded condition.
Figure 9B:
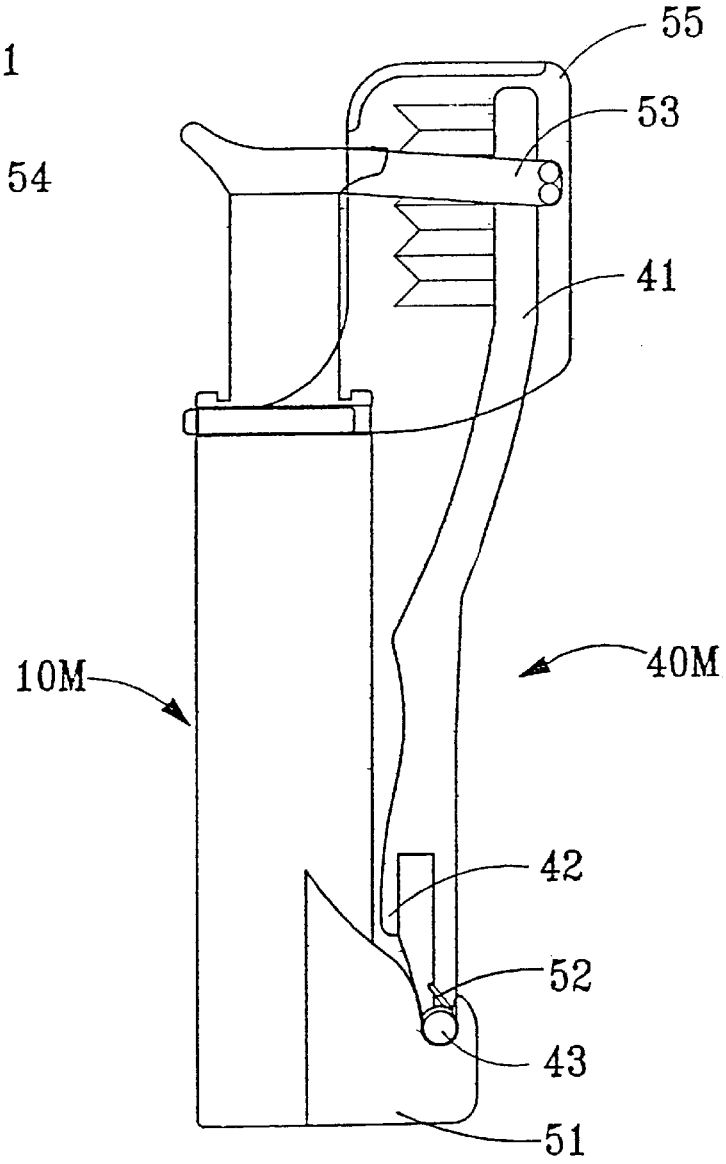
Figure 10:
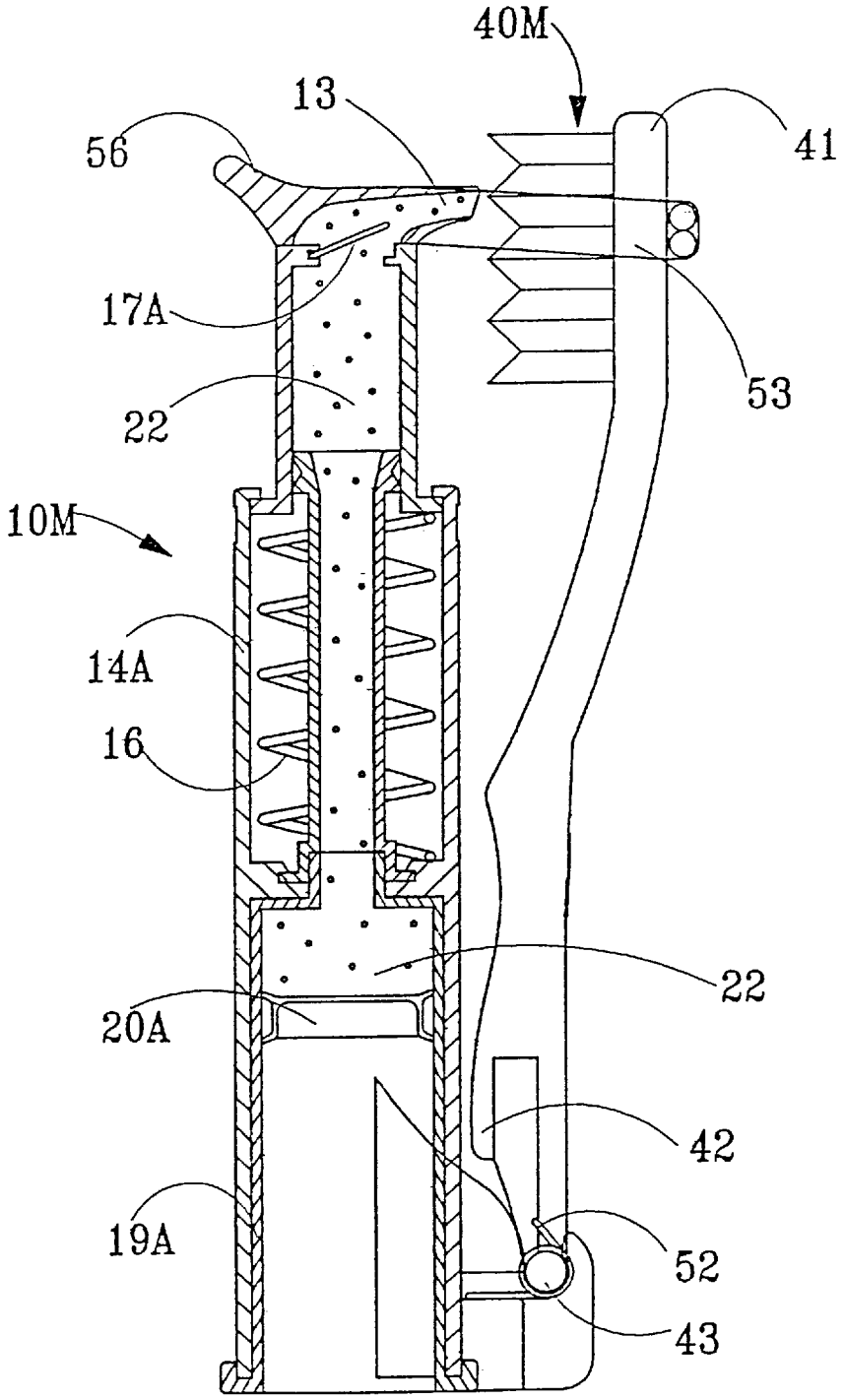
FIG. 10 illustrates another preferred embodiment of the toothbrush and toothpaste squeezing assembly.

FIGS. 8A and 8B illustrate the engagement between a toothbrush 40M with a small toothpaste squeezing assembly 10M. FIG. 9A and 9B illustrate how the toothbrush 40M is folded in a small toothpaste squeezing assembly 10M. As shown, the small toothpaste squeezing assembly 10M includes a seat 51, a spring 52, a hook 55 and a toothpaste squeezer 11M. A short-handled toothbrush 40M is pivotally connected with the seat 51 at an axle 43. The toothbrush 40M is normally disposed in a straight position so that its hook 42 may be hanged on the annular member 33. When desired to carry the toothbrush 40M outside, it is only necessary to rotate the hood 55 and then rotate the toothpaste squeezing assembly 10M through an angle of 180 degrees toward the bristles of the toothbrush 40M so that the brush head 41 will be enclosed within the hood 55 and get in contact with the protuberances 54. Then, the fixing member 53 is engaged with the back of the brush head 41 to keep the toothbrush 40M in place. Referring to FIG. 10, when in use, the head 56 is depressed to squeeze the toothpaste 22 to get out of the tubular neck 14 from the toothpaste cylinder 19A thereby pushing open the check valve 17A and coming out of the outlet 13. As the fixing member 53 is engaged with back of the brush head 41, the toothpaste 22 will be evenly applied to the bristles of the brush head 41. When moved below the brush head 41, the fixing member 53 will be disengaged from the brush head 41 and the spring 52 will force the toothbrush 40M to a straight position for use. The toothbrush 40M may be folded after use thereby making it convenient to carry outside. The toothbrush 40M, the axle 43 and the seat 51 can be connected together by connecting plate and partially or wholly made by injection molding. The tubular neck 14A is telescopic and the toothpaste cylinder 19A may be separable for facilitating replacement.

Referring to FIGS. 1, 8A, 8B, 9A and 9B, each of the toothbrushes 40 and 40M is provided with a hook 42 for hanging on the lug 33 of the annular member 32 and an axle 43 for engaging with the seat 51 of the toothpaste squeezing assembly. The hook 42 and the axle 43 are designed for making the bristles of the toothbrush align with the outlet 13. However, for electric toothbrushes, the hook 42 may be provided on a detachable power handle. The toothbrush 40 may be made of resilient foam plastic.

Figure 11:
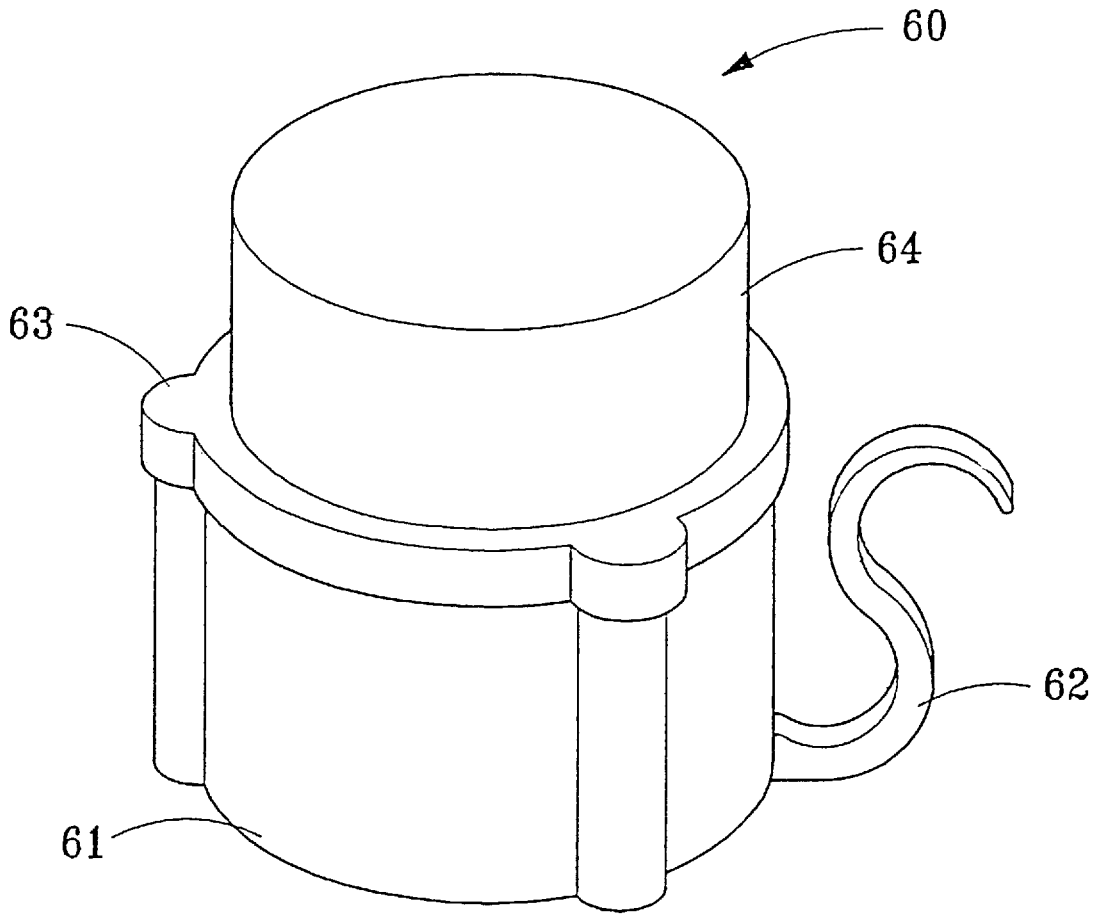
FIG. 11 is a perspective view of the spring mug.
Figure 12:
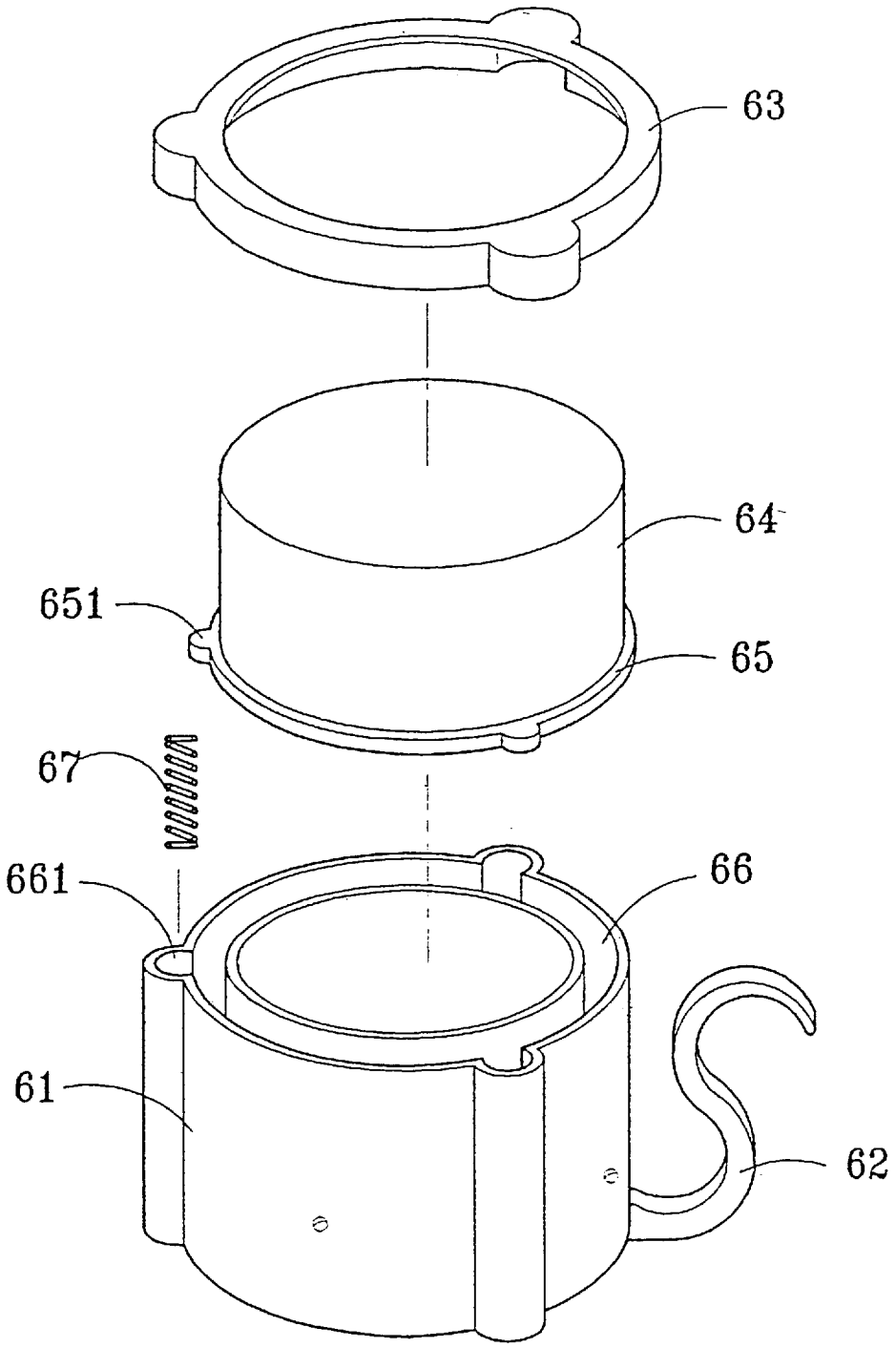
FIG. 12 is an exploded view of the spring mug.

FIGS. 11 and 12 are a perspective view and an exploded view of the spring mug 60, respectively. As shown, the spring mug 60 is made of a body 61, a bottom member 64, a ring member 63, three springs 67 and a handle 62. The body 61 has an annular groove 66 formed with three cavities 661 in each of which is fitted the spring 67. The bottom member 64 has a flange 65 formed with three projections 651. The bottom member 64 is engaged with the body 61 with the projections 651 slidably fitted in the cavities 661. The ring member 63 is sleeved over the bottom member 64 to fixedly mounted with the body 61 thereby preventing the bottom member 64 to get out of the body 61. When not in use, the bottom member 64 is forced into the body 61 so as to fit into the lower portion of the rack 70. When the spring mug 60 is removed from the rack 70, the springs 67 will force the bottom member 64 to go outwardly thereby increasing the capacity of the spring mug 60. The annular groove 66 with three cavities 661 may be replaced with a larger circular groove adapted to receive a single spring.

Figure 13:
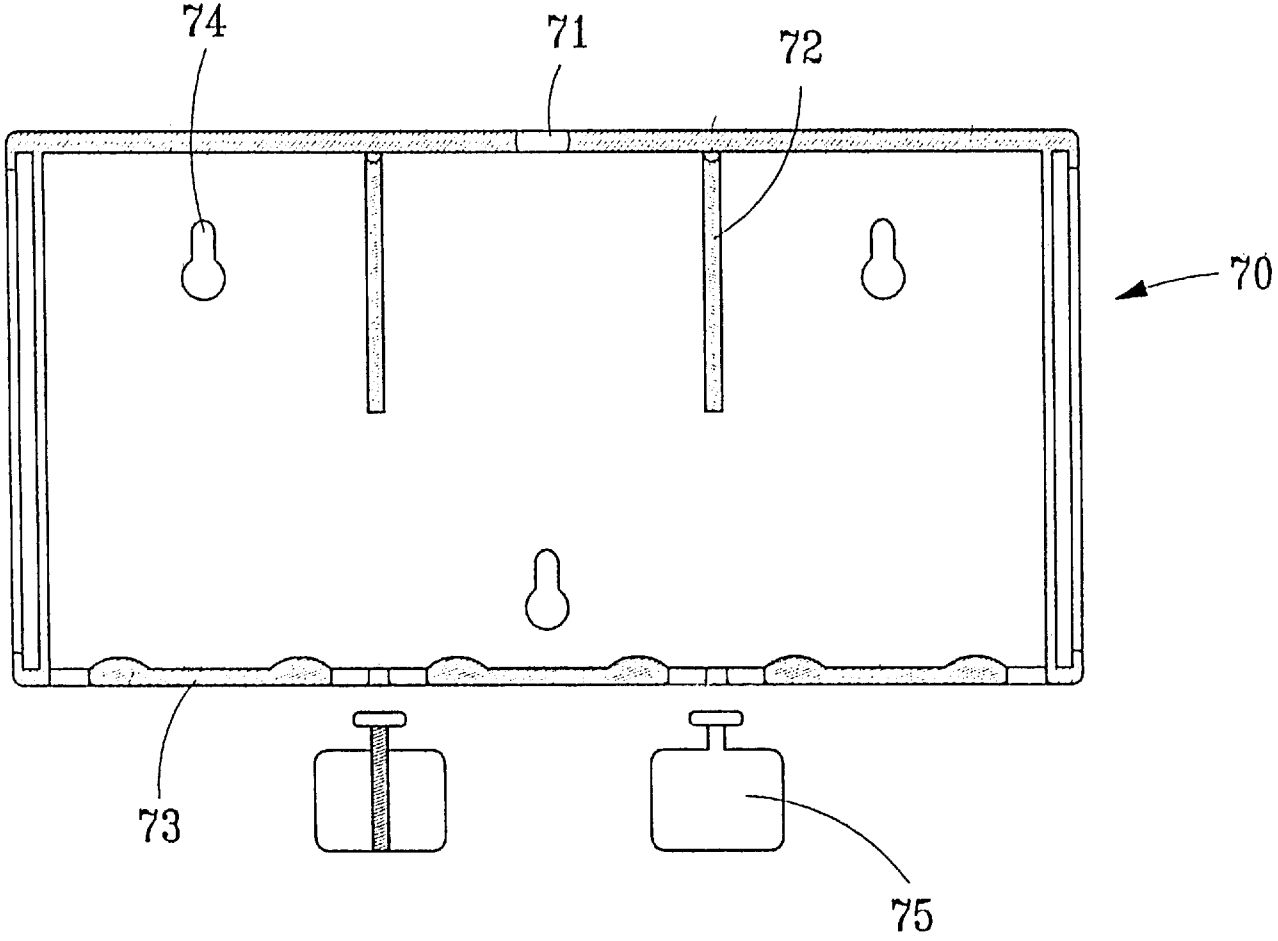
FIG. 13 is a sectional view of the rack.

Referring to FIG. 13, the upper portion of the rack 70 is formed with a hole 71 adapted to engage with a ball-shaped end 39 at the lower end of the toothpaste squeezing assembly 10. The interior of the rack 70 is divided by two partitions 72 into three chambers for receiving spring mugs 60. The rack 70 has two holes 4 for hanging on the wall and is provided with hook plates 75 at the bottom. The inner bottom of the rack 70 is provided with slip-proof pads 73.

The above-mentioned component parts form the tooth cleaning assembly according to the present invention. On the rack 70 is mounted toothpaste squeezing assembly 10 on which are hanged toothbrushes 40 and 40M. Spring mugs 60 or 60A and a folding mirror 80 are fitted within the rack 70.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A tooth cleaning assembly comprising:

a rack;

at least a detachable toothpaste squeezing assembly mounted on said rack and including a base, a toothpaste cylinder having a lower end fitted in said base, an annular member arranged an upper end of said toothpaste cylinder, a cover fitted on a top of said toothpaste cylinder and mounted on said annular member, a tubular neck telescopically fitted in said toothpaste cylinder, a cap pivotally connected with an upper end of said tubular neck, and a movable knob extending through said rack to be detachably engaged with a bottom of said base;

at least a toothbrush detachably mounted on said annular member;

at least a spring mug fitted within said rack;

at least a folding mirror fitted within said rack.

2. The tooth cleaning assembly as claimed in claim 1, wherein said toothpaste squeezing assembly includes at least a toothpaste squeezer provided with a music integrated circuit or resiliently closed air whistle.

3. The tooth cleaning assembly as claimed in claim 1, wherein said toothbrush is pivotally and foldably connected with said toothpaste squeezer.

4. The tooth cleaning assembly as claimed in claim 1, wherein said cover, said toothpaste cylinder, said base, or pivot of short-handled toothbrush, seat and tubular neck can be partially or wholly made integrally.

5. The tooth cleaning assembly as claimed in claim 2, wherein said toothpaste squeeze, has a fixing member which may be arranged at a detachable power handle of an electric toothbrush.

6. The tooth cleaning assembly as claimed in claim 1, wherein said spring mug includes a body having an annular groove with three cavities in each of which is fitted a spring or a circular groove in which is fitted a spring, a bottom member having a flange, a ring member sleeved over said bottom member to be fixedly mounted on said body.

* * * * *